US009585462B2

(12) United States Patent
Engdahl et al.

(10) Patent No.: US 9,585,462 B2
(45) Date of Patent: Mar. 7, 2017

(54) DEVICE FOR CARRYING AN OBJECT

(71) Applicant: USWE Sports AB, Staffanstorp (SE)

(72) Inventors: Karl-Johan Engdahl, Skurup (SE); Jörgen Gustafsson, Staffanstorp (SE)

(73) Assignee: USWE SPORTS AB, Staffanstorp (SE)

( * ) Notice: Subject to any disclaimer, the term of this patent is extended or adjusted under 35 U.S.C. 154(b) by 0 days.

(21) Appl. No.: 15/081,896

(22) Filed: Mar. 27, 2016

(65) Prior Publication Data

US 2016/0278508 A1 Sep. 29, 2016

(30) Foreign Application Priority Data

Mar. 27, 2015 (EP) ..... 15161390

(51) Int. Cl.

| | |
|---|---|
| ***A45F 3/04*** | (2006.01) |
| ***A45F 3/10*** | (2006.01) |
| ***A45F 3/12*** | (2006.01) |
| *A45F 3/00* | (2006.01) |
| *A45F 3/02* | (2006.01) |
| *A45F 3/14* | (2006.01) |

(52) U.S. Cl.

CPC ..... *A45F 3/04* (2013.01); *A45F 3/047* (2013.01); *A45F 3/10* (2013.01); *A45F 3/12* (2013.01); *A45F 3/14* (2013.01); *A45F 2003/007* (2013.01); *A45F 2003/025* (2013.01); *A45F 2003/045* (2013.01); *A45F 2003/146* (2013.01)

(58) Field of Classification Search

CPC ..... A45F 3/04; A45F 3/12; A45F 3/14
USPC ..... 224/638, 639, 637, 635, 641
See application file for complete search history.

(56) References Cited

U.S. PATENT DOCUMENTS

| | | | | |
|---|---|---|---|---|
| 5,114,059 A * | 5/1992 | Thatcher | A45F 3/04 224/148.5 |
| 5,333,768 A | 8/1994 | Krentz | |
| 5,451,121 A * | 9/1995 | Seligman | B63C 11/08 405/186 |
| 5,607,258 A * | 3/1997 | Eungard | B63C 11/2245 224/650 |
| 5,662,433 A * | 9/1997 | Seligman | A41D 13/0125 114/315 |

(Continued)

FOREIGN PATENT DOCUMENTS

| | | |
|---|---|---|
| GB | 2 502 657 | 12/2013 |
| WO | 2010/077196 | 7/2010 |

OTHER PUBLICATIONS

International Search Report dated Jul. 14, 2016 for corresponding International application No. PCT/EP2016/056288.

*Primary Examiner* — Brian D Nash
(74) *Attorney, Agent, or Firm* — Renner, Otto, Boisselle & Sklar, LLP

(57) ABSTRACT

A device for carrying an object, comprising first and second shoulder straps, first and second chest straps to be fitted around the lower chest of a person, and a back portion connecting a first end of the shoulder straps with a first end of the chest straps. Second ends of the shoulder straps are connected to the chest straps, and second ends of the chest straps are detachably connectable to each other by means of a buckle. Lengths of the chest straps are adjustable. Each of the chest straps comprises at least an elastic section, said elastic section being elastically extendable in a longitudinal direction of the chest straps. Disclosed is also a backpack comprising such a device.

13 Claims, 9 Drawing Sheets

(56) References Cited

Figure 1:
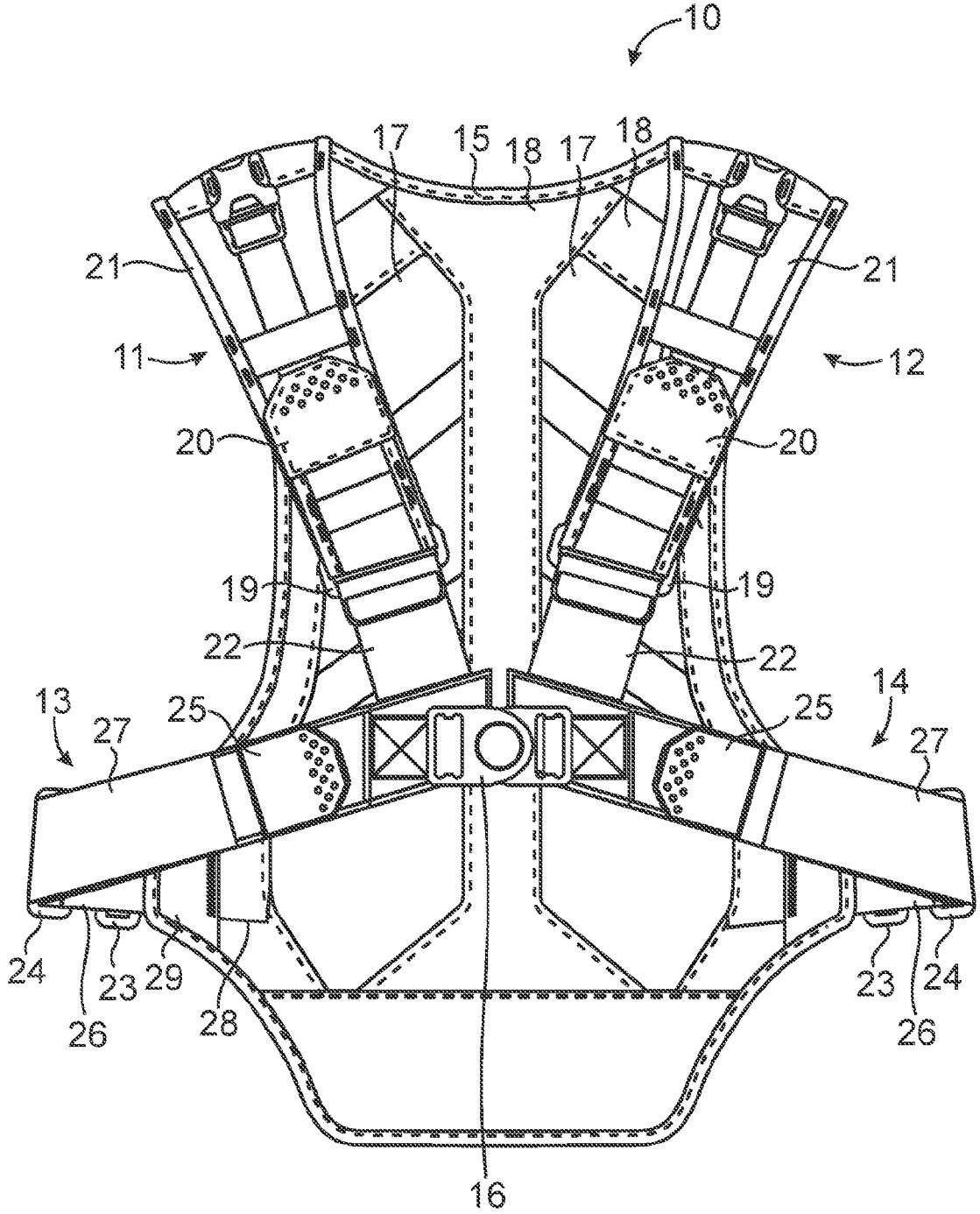

U.S. PATENT DOCUMENTS 5,864,880 A * 2/1999 Adam ..... A41D 1/04 2/108
5,984,157 A * 11/1999 Swetish ..... A45F 3/10 224/631
6,375,053 B1 * 4/2002 Cecchinel ..... A45F 3/04 224/264
6,402,429 B1 * 6/2002 James ..... B63C 11/08 405/186
6,802,442 B1 * 10/2004 Thompson ..... A44B 11/14 224/259
7,156,918 B2 * 1/2007 Marks ..... A45C 13/28 116/215
8,468,614 B2 * 6/2013 Engdahl ..... A45F 5/02 2/415
8,814,016 B2 * 8/2014 Murdoch ..... A45F 3/04 224/581
8,822,011 B2 * 9/2014 Gingo ..... B32B 5/18 156/243
8,833,623 B2 * 9/2014 Scicluna ..... A45C 13/30 224/607
2002/0162872 A1 11/2002 Cascioli
2002/0189003 A1 * 12/2002 Babcock ..... A45F 3/14 2/268
2005/0051582 A1 * 3/2005 Frost ..... A47D 13/025 224/160
2005/0087577 A1 * 4/2005 Thompson ..... A44B 11/14 224/641
2005/0092802 A1 * 5/2005 Maley ..... A45F 3/08 224/628
2006/0000856 A1 * 1/2006 West ..... A45F 3/04 224/148.2
2006/0102676 A1 * 5/2006 Gibson ..... A45F 3/04 224/637
2007/0152007 A1 * 7/2007 Kauss ..... A45F 3/14 224/637
2008/0217367 A1 * 9/2008 Lillie ..... A45F 3/047 224/148.2
2010/0163338 A1 * 7/2010 Wood ..... A62B 35/04 182/6
2012/0283794 A1 * 11/2012 Kaib ..... A61N 1/3968 607/5
2014/0224582 A1 * 8/2014 Wood ..... A62B 1/14 182/6
2015/0053735 A1 * 2/2015 Murdoch ..... A45F 3/005 224/640
2015/0129623 A1 * 5/2015 Stuart ..... A45F 3/04 224/259
2015/0313347 A1 * 11/2015 Murdoch ..... A45F 3/04 224/637
2016/0016043 A1 * 1/2016 Rose ..... A45F 3/04 441/114
2016/0037895 A1 * 2/2016 Humphreys ..... A45F 3/08 224/633

* cited by examiner

DEVICE FOR CARRYING AN OBJECT

This application claims priority of European Application No. 15161390.8 filed Mar. 27, 2015, which is hereby incorporated herein by reference.

FIELD OF THE INVENTION

The present invention relates to a device for carrying an object. The device comprises first and second shoulder straps and a back portion. Devices of this type are generally used for carrying an object on the back of a person. One type of object to be carried by the device is, for example, a container for a liquid, such as water or another liquid for drinking. For example, one type of object to be carried by the device is a hydration system, comprising a container for a liquid and a tubing for conducting the liquid inside the container to the mouth of a person. Such hydration systems are, for example, used within sports and outdoor life. Devices of this type are generally arranged as a harness or similar connected to a carrying structure to form a backpack.

PRIOR ART

A plurality of different types of devices for carrying objects are known in the prior art. Numerous types of backpacks have been known for a long time. One such type of backpack comprises shoulder straps, a back portion and waist straps to be fitted around the waist of a person. The waist straps are provided with a buckle for connecting the ends of the waist straps. The back portion can be provided with an element forming a container for carrying objects. Alternatively, the back portion comprises fastening straps or a structure for fastening one or more objects to it. The shoulder straps and the waist straps can be adjustable in length, for example, by running through a fastening buckle, wherein the strap running through the fastening buckle can be pulled further through the fastening buckle for tightening, and wherein the fastening buckle can be tilted to allow loosening of the straps.

One problem with such prior art devices for carrying objects is that they are uncomfortable to use and give rise to a plurality of adverse effects due to their structure, particularly during physically demanding activities. Hence, there is a need for improving such prior art devices for carrying objects.

SUMMARY OF THE INVENTION

One object of the present invention is to avoid the above identified problems and provide a device for carrying objects which is comfortable to use, particularly during physically demanding activities, such as in sports.

The present invention relates to a device for carrying an object, comprising first and second shoulder straps, first and second chest straps to be fitted around the lower chest of a person, and a back portion connecting a first end of the shoulder straps with a first end of the chest straps, wherein second ends of the shoulder straps are connected to the chest straps, wherein second ends of the chest straps are detachably connectable to each other by means of a buckle, and wherein lengths of the chest straps are adjustable, characterised in that each of the chest straps comprises at least an elastic section, said elastic section being elastically extendable in a longitudinal direction of the chest straps. The structure of the device with shoulder straps, chest straps and the elastic section of the chest straps results in a device that is comfortable for a user to wear, holds the object to be carried in the desired position and minimises obstruction of chest expansion also during heavy breathing. Hence, the device according to the invention allows expansion of the chest, while simultaneously keeping the device, possibly with the object or objects to be carried, snuggly fitted on the user.

First strap parts of the chest straps can form the elastic section. Said first strap parts can comprise an elastically extendable outer portion and an elastically extendable inner portion, wherein the inner portion can be attached to the back portion. One end of the inner portion can be attached to the back portion and the inner portion can entirely overlap the back portion. Hence, the inner portion extends over the back portion or into a sleeve of the back portion, which results in the possibility of a substantially longer elastic section than if the end of the elastic portion was attached to the periphery of the back portion. A longer elastic portion of the chest straps makes it easier to reduce problems with breathing obstruction while maintaining the comfort of the device. The total length of the elastic section can be at least 100 mm. The length of the inner portion can be at least 50 mm. The elastic section can be elastically extendable at least 50% of its length in the longitudinal direction.

The chest straps can be provided with a stopping element, such as a non-elastic cord or similar, to prevent the elastic section from being elastically extended beyond a predetermined length. This prevents the elastic sections from being damaged due to exaggerated extension. Any elastic section of the device can be provided with such a stopping element.

The device can comprise first and second loops arranged with a space between them for length adjustment of the chest straps. A part of the chest straps can extend through either of said loops and can be detachably connectable to itself and length adjustable. Said structure results in substantial possibilities of size adjustment, first by selecting one of the first and second loops and then by connecting the chest strap in the desired position once it has been inserted through said loop. The chest straps can comprise a hook and loop fastener, such as Velcro™. Such length adjustment possibilities in combination with the elastic section further improves the possibilities of achieving a snuggly fit without obstructing breathing.

The shoulder straps can comprise an elastic part forming a bounce absorber. As a result the device is further prevented from bouncing on the user, also during physically demanding activities, such as in sports. Further, the comfort can be increased. It is also believed that a combination of elastic sections of the chest straps and elastic parts of the shoulder straps result in a particularly favourable device for carrying objects with great comfort.

The back portion can be provided with a structure for receiving the object to be carried, such as a backpack compartment. Hence, the device can be formed as a backpack.

Further characteristics and advantages of the present invention will become apparent from the description of the embodiments below, the appended drawings and the dependent claims.

SHORT DESCRIPTION OF THE DRAWINGS

Figure 2:
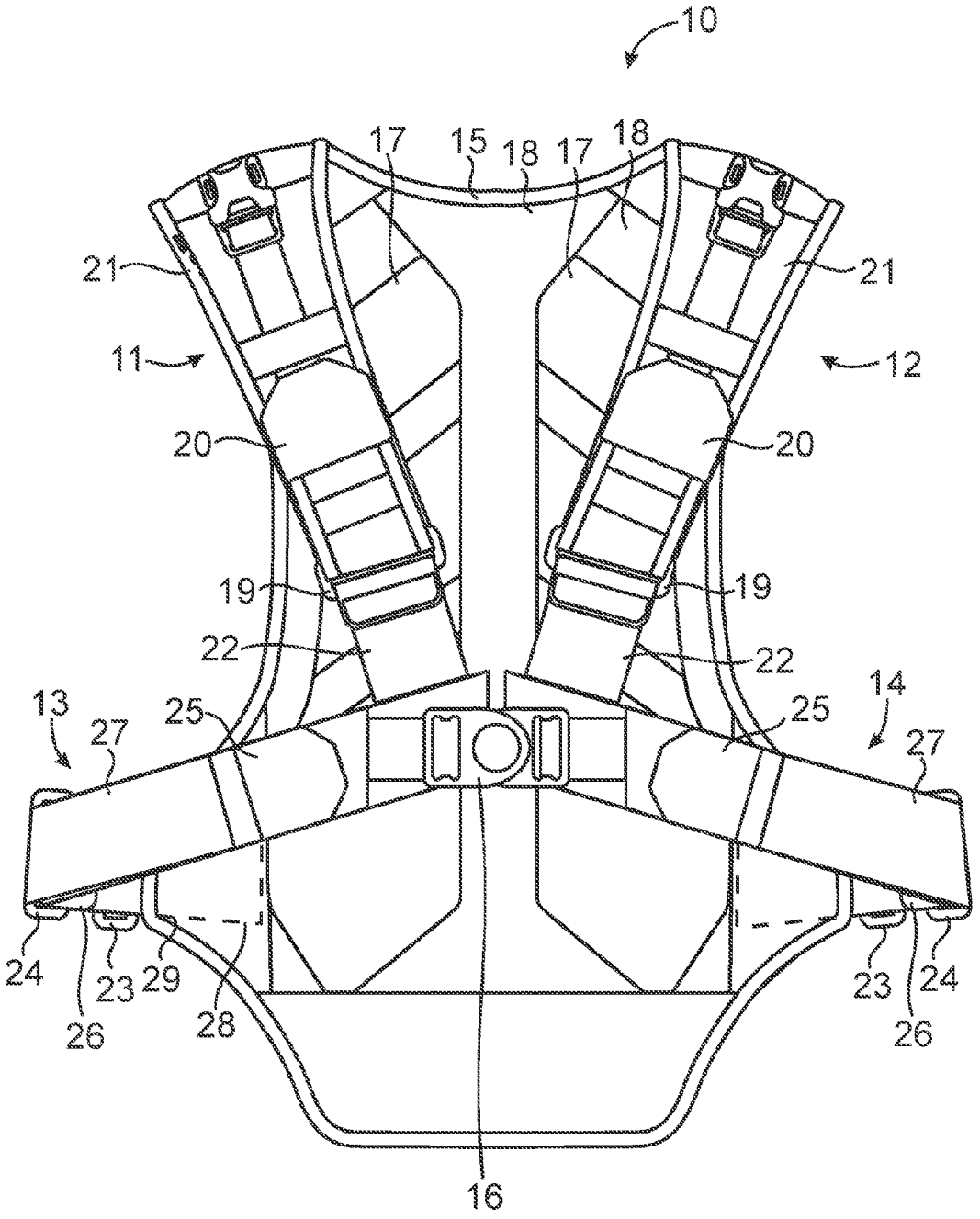
Figure 3:
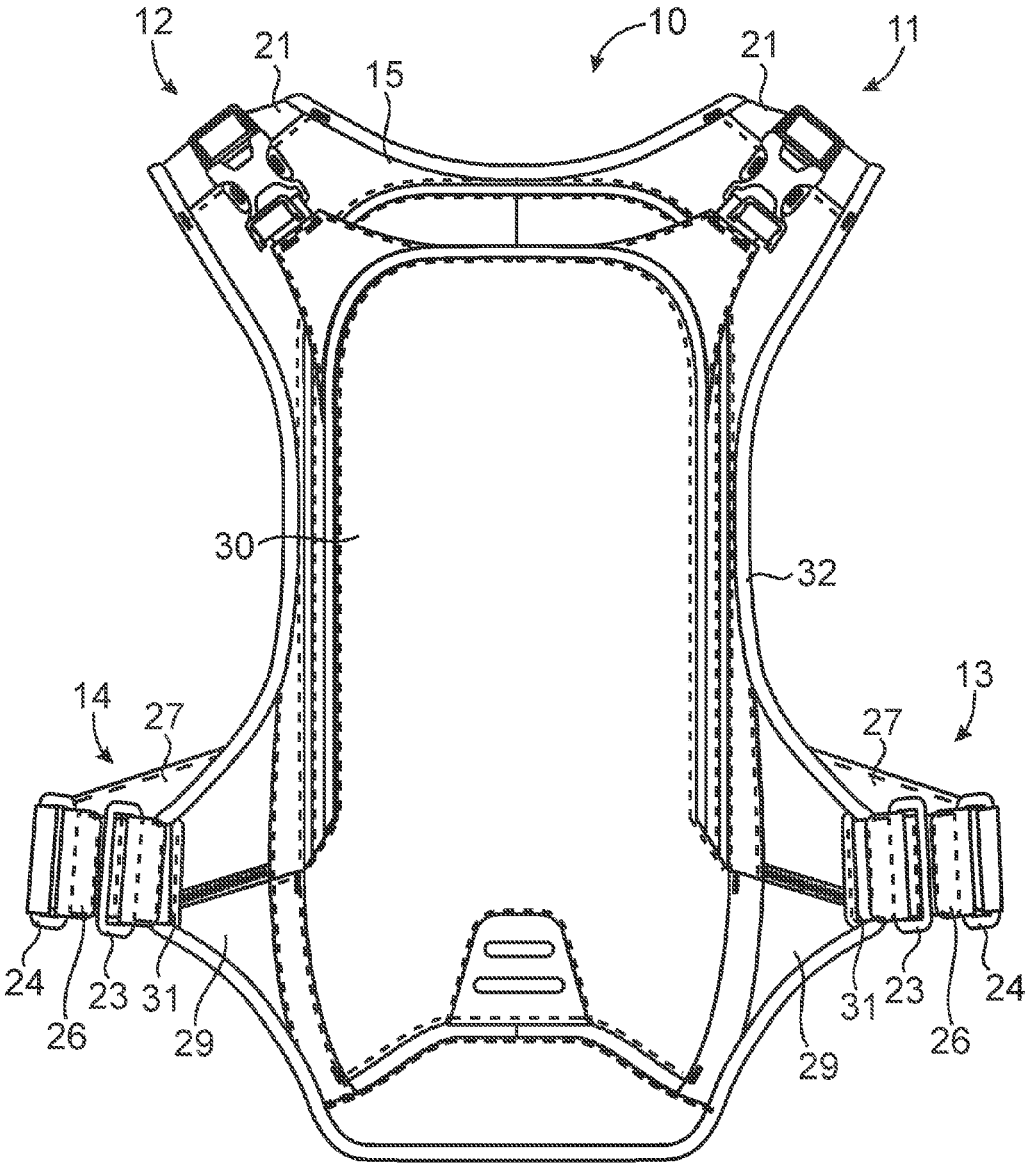
Figure 4:
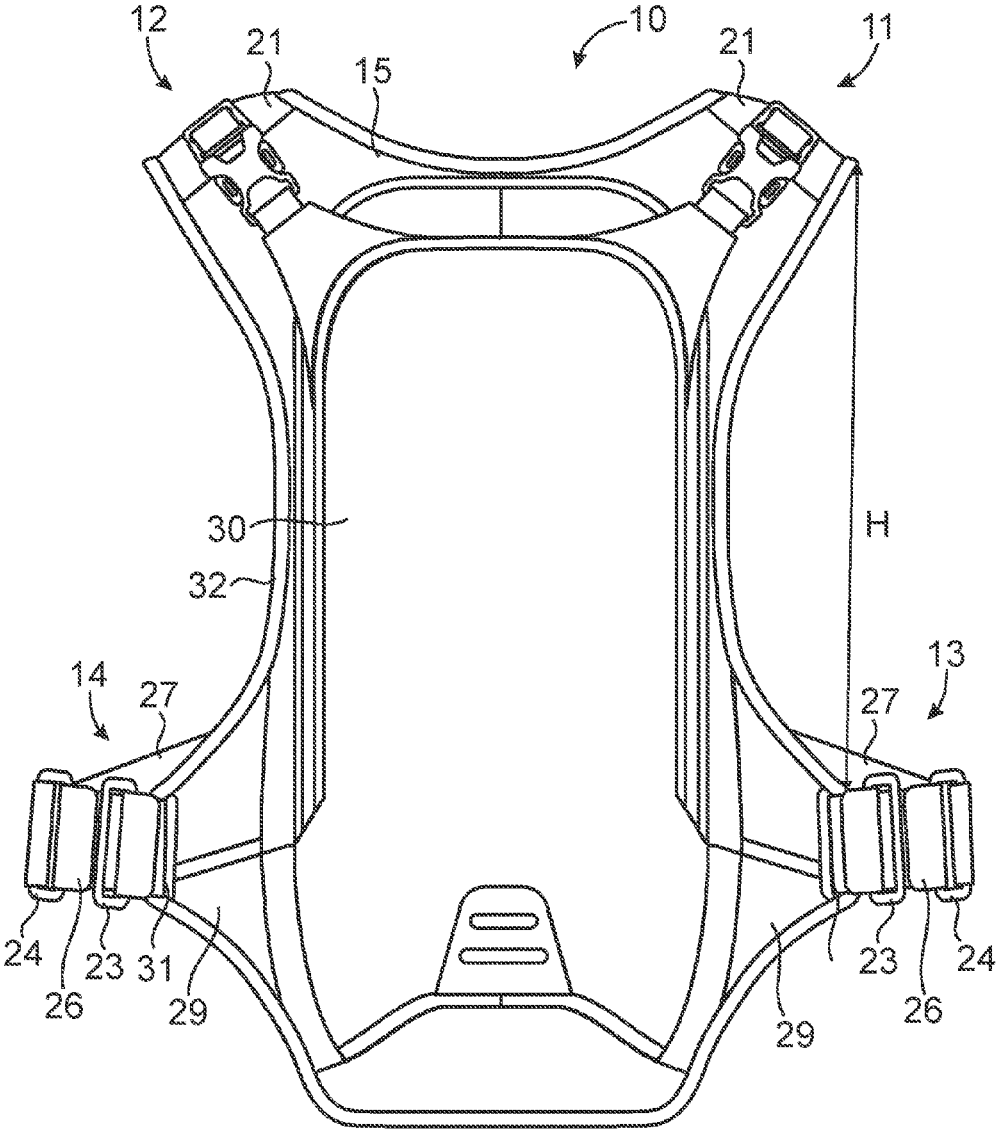
Figure 5:
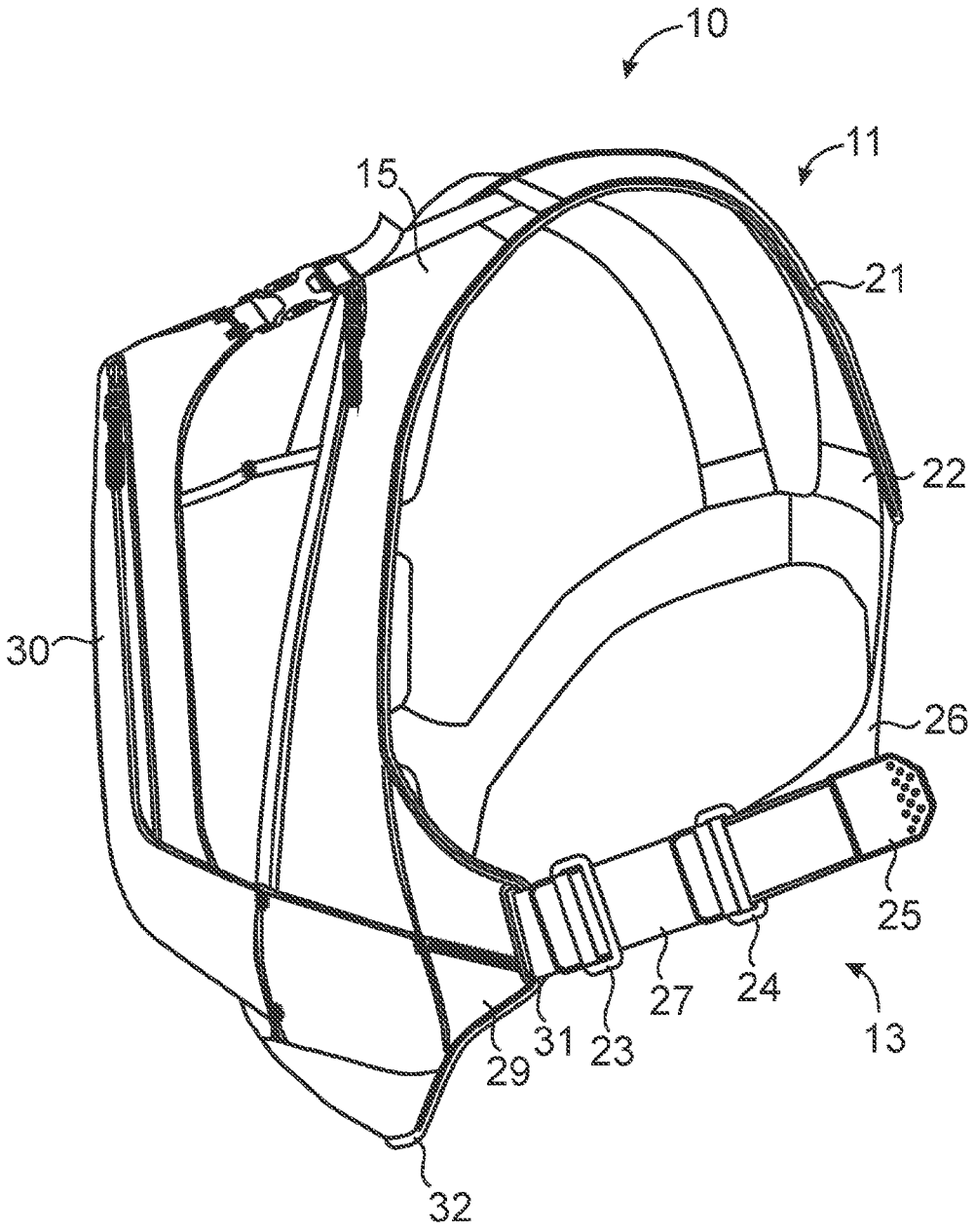
Figure 6:
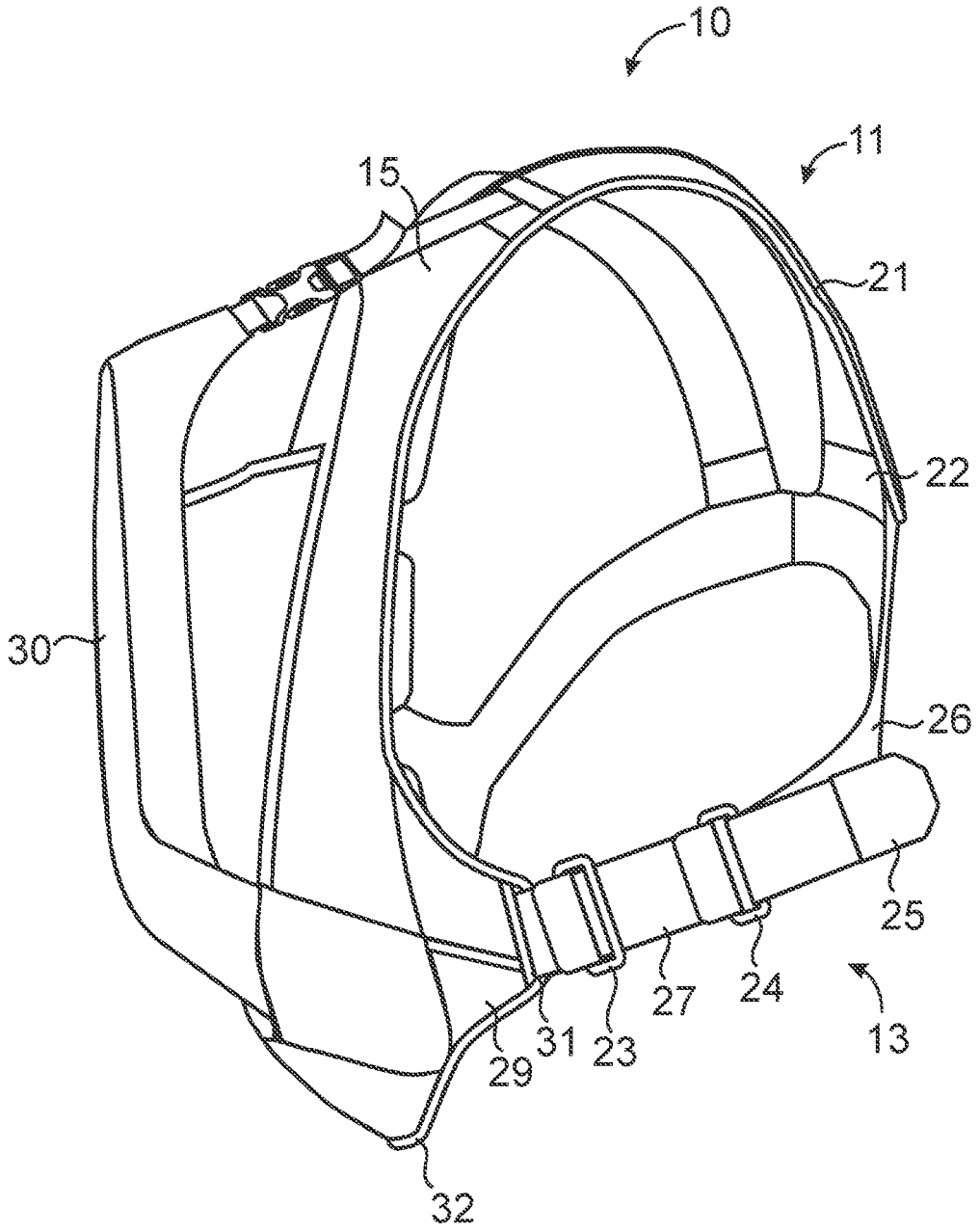
Figure 7:
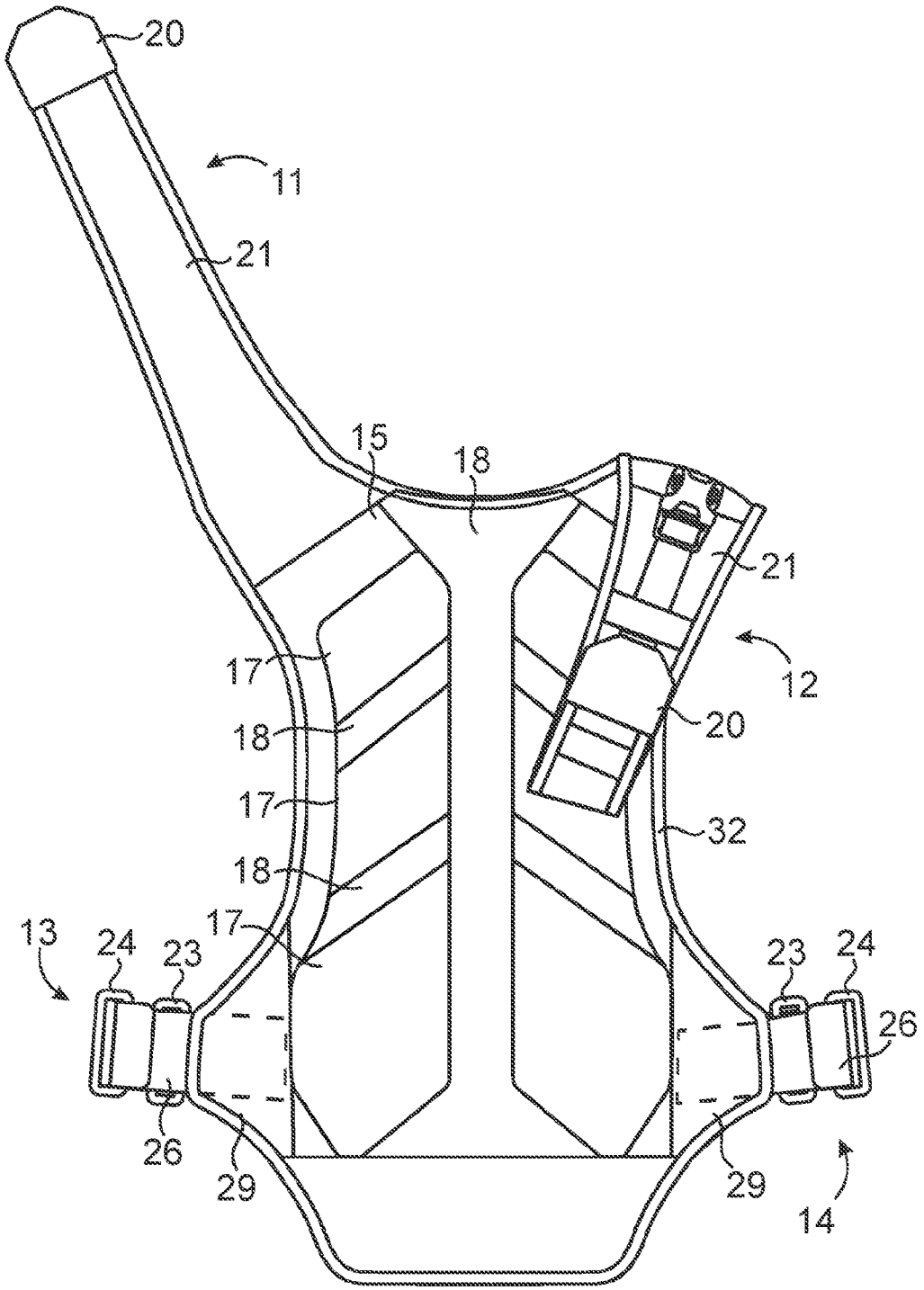
Figure 8:
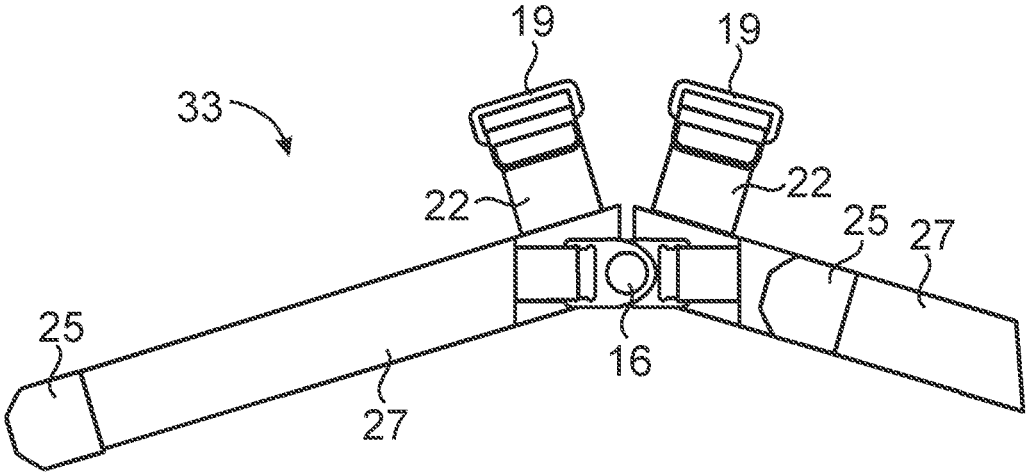
Figure 9:
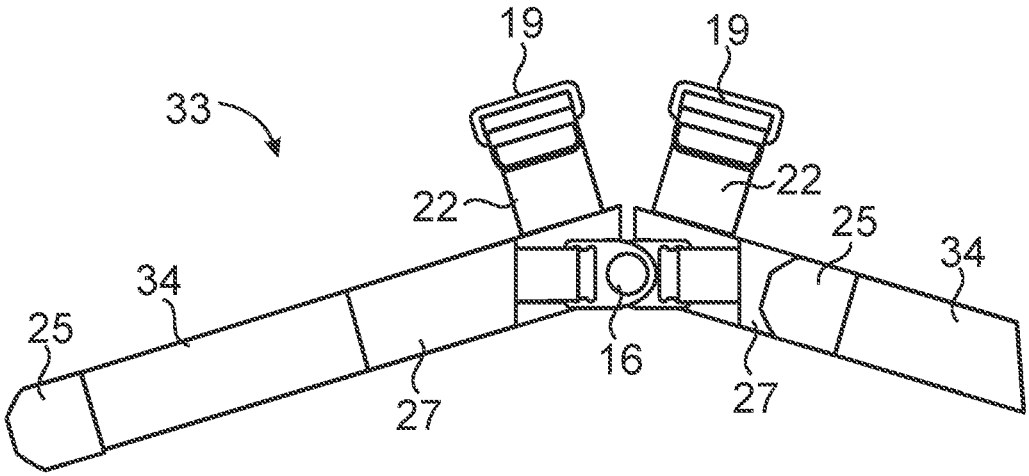
Figure 10:
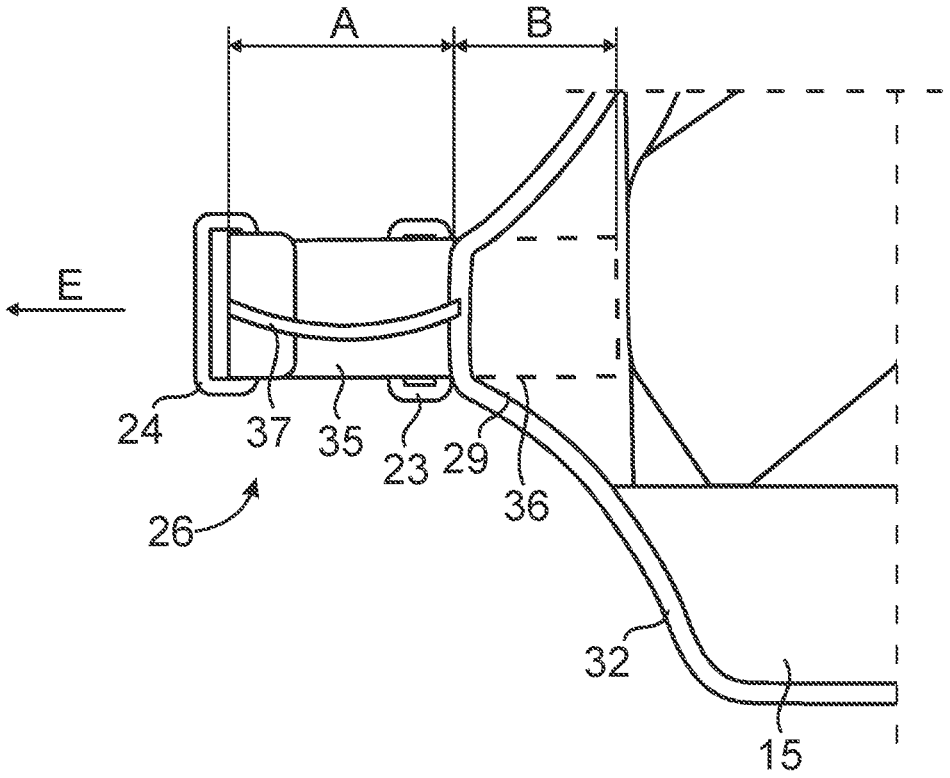

The invention will now be described more in detail with the aid of embodiments and with reference to the appended drawings, in which FIG. 1 is a schematic front view of a device for carrying objects according to one embodiment of the invention, illustrating shoulder straps, a back portion and chest straps connected to each other in a position for wearing by a person, FIG. 2 is a schematic view of the device according to another embodiment, wherein the device is illustrated in a simplified manner without stitches and similar details, FIG. 3 is a schematic rear view of the device according to FIG. 1, FIG. 4 is a schematic rear view according to FIG. 3, wherein the device is illustrated in a simplified manner without stitches and similar details, FIG. 5 is a schematic side view of the device according to FIG. 1, FIG. 6 is a schematic side view according to FIG. 5, wherein the device is illustrated in a simplified manner without stitches and similar details, FIG. 7 is a schematic front view of a part of the device, illustrating the back portion, a first strap portion of the shoulder straps and a first strap part of the chest straps, wherein a front part comprising a second strap portion of the shoulder straps and a second strap part of the chest straps have been removed, FIG. 8 is a schematic front view of the front part according to one embodiment, FIG. 9 is a schematic front view of the front part according to one alternative embodiment, and FIG. 10 is a schematic rear view of a part of the device according to one embodiment, illustrating the first strap part of one of the chest straps.

DETAILED DESCRIPTION OF THE INVENTION

With reference to the drawings and particularly FIGS. 1 and 2 a device 10 for carrying an object is illustrated schematically. The device 10 is arranged for carrying an object. For example, the device comprises a backpack compartment or a backpack carrying structure for carrying a fluid container or any other type of object. For example, the device 10 is arranged for supporting a hydration system comprising a fluid container with a drinking fluid and a conduit for conducting said fluid to a person wearing the device. For example, the device 10 is arranged for a person to wear so that the object can be carried on the back of the person. Alternatively, the device 10 is arranged for the object to be carried at the front of the user, such as at the chest, or at the sides of the user, such as at the sides of the chest. For example, the device 10 comprises textile materials, optionally with cushions or pads of foam materials or similar dampening and weight distributing structures. For example, the device 10 is arranged as a backpack or a harness.

The device 10 comprises a first shoulder strap 11, a second shoulder strap 12, a first chest strap 13, a second chest strap 14 and a back portion 15. The shoulder straps 11, 12 are arranged to be fitted over the shoulders of the user, wherein the chest straps 13, 14 are arranged to be fitted around the lower chest of the user. In the illustrated embodiment the shoulder straps 11, 12 and the chest straps 13, 14 are elongated and flexible. The back portion 15 connects a first end of the shoulder straps 11, 12 with a first end of the chest straps 13, 14. An opposite second end of each shoulder strap 11, 12 is connected to the chest straps 13, 14. For example, the second end of the shoulder straps 11, 12 is connected to a front portion at or in the vicinity of a second end of the chest straps 13, 14, said second ends of the chests straps 13, 14 being opposite to the first ends thereof. The second ends of the chest straps 13, 14 are detachably connectable to each other by means of a chest buckle 16. In the illustrated embodiment the shoulder straps 11, 12 and the chest straps 13, 14 are fixed to the back portion 15, such as by means of stitches or in another suitable manner. Alternatively, the shoulder straps 11, 12 and/or chest straps 13, 14 are detachably connected to the back portion 15, such as by means of a hook and loop fastener, buttons, zippers, buckles, etc. In this context hook and loop fasteners include Velcro™ and similar types of fasteners. For example, the shoulder straps 11, 12 are integrated with the back portion 15.

The back portion 15 connects the first ends of the shoulder straps 11, 12, such as top or rear ends thereof, with the first ends of the chest straps 13, 14, such as rear ends thereof. In the illustrated embodiment the back portion 15 is arranged to extend from the neck of a person to the lower chest or the waist. Alternatively, the back portion 15 is formed by a much smaller connection between the first ends of the shoulder straps 11, 12 and the first ends of the chest straps 13, 14, wherein the shoulder straps 11, 12 extends over the shoulders and along the upper back of the user to an extent corresponding to the size of the back portion 15. In the illustrated embodiment the back portion 15 comprises cushions 17, e.g. including a foam material, to provide a comfortable engagement with the back of the user. For example, the cushions 17 are distributed with a spacing between them to form channels 18 in the back portion 15 to provide less pressure on the back of the user in the areas of said channels 18 and possibly also to provide air ventilation to reduce effects of heat and moisture on the back of the user.

A length of the shoulder straps 11, 12 is adjustable. In the illustrated embodiment the device 10 comprises a loop 19 through which loop 19 a part of the shoulder strap 11, 12 is inserted, folded back and attached to itself, for example by means of a hook and loop fastener. For example, each of the shoulder straps 11, 12 is provided with the loop 19. The loop 19 is arranged at the front of the device 10, such as at the chest straps 13, 14 or with a distance to the chest straps 13, 14 of less than 100 mm, wherein the length adjustment of the shoulder straps 11, 12 are facilitated. Alternatively, the loop 19 is arranged closer to the shoulder of the user, such as at a top portion of the shoulder straps 11, 12. For example, the shoulder straps 11, 12 comprise pull tabs 20 to be gripped by the user for length adjustment of the shoulder straps 11, 12. In the illustrated embodiment each of the shoulder straps 11, 12 comprise a first strap portion 21 and a second strap portion 22. The first strap portion 21, comprising the pull tab 20, extends through the loop 19 and is detachably connectable to itself and is length adjustable by means of the hook and loop fastener or another suitable type of fastener. The pull tab 20 is arranged at a free end of the first strap portion 21. Hence, the pull tab 20 is inserted through the loop 19, wherein the part of the first strap portion 21 with the pull tab 20 is folded back onto the remaining part of the first strap portion 21 for fastening therewith at the desired position.

A length of the chest straps 13, 14 is adjustable. In the illustrated embodiment the device 10 is provided with a first loop 23 and a second loop 24 for the chest straps 13, 14, wherein the device 10 is provided with a pair of loops 23, 24 for each of the chest straps 13, 14. The first and second loops 23, 24 are arranged with a space between them in a direction along the chest straps 13, 14, wherein a user can choose one of the first and second loops 23, 24 for length adjustment of the chest straps 13, 14. A part of the chest strap 11, 12 is inserted through one of said first and second loops 23, 24, folded back and attached to itself, for example by means of a hook and loop fastener. For example, the first and second loops 23, 24 are arranged at the side of the user, such as in the vicinity of the first end of the chest straps 13, 14 to facilitate length adjustment of the chest straps 13, 14. Alternatively, the first and second loops 23, 24 are arranged closer to the buckle 16 and the second end of the chest straps 13, 14. For example, also the chest straps 13, 14 comprises pull tabs 25 to be gripped by the user for length adjustment of the chest straps 13, 14 by means of a hook and loop fastener or similar. In the illustrated embodiment each of the chest straps 13, 14 comprise a first strap part 26 and a second strap part 27. The second strap part 27, comprising the pull tab 25, extends through one of the first and second loops 23, 24 and is detachably connectable to itself and is length adjustable by means of the hook and loop fastener or another suitable type of fastener. Hence, the pull tab 25 of the chest strap 13, 14 is inserted through one of the first and second loops 23, 24, wherein the part of the second strap part 27 with the pull tab 25 is folded back onto the remaining part of the second strap part 27 for fastening therewith at the desired position. In the illustrated embodiment the first strap part 26 is provided with the first and second loops 23, 24. Alternatively, the first and second loops 23, 24 are arranged on the back portion 15.

Each of the chest straps 13, 14 comprise at least an elastic section, said elastic section being elastically extendable in a longitudinal direction of the chest straps 13, 14. In the illustrated embodiment the elastic section corresponds to the first strap part 26 of the chest straps 13, 14. Hence, the first strap part 26 is formed in an elastic material, such as an elastic fabric. Alternatively, the second strap part 27 comprises the elastic section. Alternatively, the second strap part 27 is formed in an elastic material, such as elastic fabric or elastic hook and loop fastener material. Alternatively, the entire chest straps 13, 14 are made of elastic material. Hence, at least a section of each of the chest straps 13, 14 is arranged elastic to provide a snuggly and comfortable fit around the chest of the user to prevent the device 10 with the carried object from bouncing when the user perform physically demanding activities, such as sports. Further, the chest straps 13, 14 are arranged sufficiently elastic so as not to obstruct the chest from expanding due to heavy breathing.

In the illustrated embodiment the first strap part 27 is formed in the elastic material and forms the elastic section of the chest straps 13, 14. The back portion 15 is formed with a sleeve 28 for receiving a portion of the first strap part 26, wherein said portion of the first strap part 26 extends into the sleeve 28 and is attached to the back portion 15 inside said sleeve 28. In the illustrated embodiment the back portion 15 comprises a projection 29 on the right and left sides, said projections 29 extending substantially in a direction towards the chest straps 13, 14. The projections 29 are provided with the sleeve 28. In FIG. 2 the first strap part 26 is illustrated extending into said sleeve 28 by means of dashed lines.

With reference particularly to FIGS. 3-6 the back portion 15 is provided with one or more backpack compartments 30 for receiving the object to be carried. The backpack compartment 30 is, for example, arranged in a conventional manner on the back portion 15. Alternatively, the device 10 comprises fastening means for fastening the object to be carried.

In the illustrated embodiment the projections 29 are provided with an aperture 31 leading into the sleeve 28. Alternatively, the aperture 31 is arranged in another location on the back portion 15, such as closer to a central part of the back portion 15 and in line with the chest straps 13, 14. In the illustrated embodiment, the aperture 31 is arranged on an outer or rear side of the projections 29, e.g. next to a peripheral seam 32 thereof. Alternatively, the aperture 31 is arranged on an inner or front side of the projections 29.

In the illustrated embodiment the second strap part 27 of the chest straps 13, 14 extends through the second loop 24 arranged at the end of the first strap part 26. However, it is understood that the second strap part 27 is detachable from the second loop 24 and instead can be positioned through the first loop 23 for tightening of the chest straps 13, 14 around the chest of the user. Additionally, the chest straps 13, 14 can be adjusted in length by selecting how much of the second strap part 27 is drawn through the selected loop 23, 24 and then attached to itself by means of the hook and loop fastener or similar.

The chest straps 13, 14 are arranged to be snuggly fitted around the chest of a user and not around the waist. For example, a distance H between an outer top portion of the shoulder straps 11, 12 and the point of engagement between the chest straps 13, 14 and the back portion 15 is less than 400 mm, as illustrated in FIG. 4.

With reference to FIG. 7 a part of the device 10 is illustrated, wherein a front part, comprising the second strap portion 22 of the shoulder straps 11, 12 and the second strap part 27 of the chest straps 13, 14, has been removed. In FIG. 7 the first shoulder strap 11 is unfolded, wherein the second shoulder strap 12 is in a folded position as it would if connected to the loop 19 of the second strap portion 22. Hence, inner sides of the first shoulder strap 11 and the back portion 15 are illustrated. The shoulder straps 11, 12 are provided with the pull tabs 20, which are at a free end thereof when unfolded. The first strap parts 26 of the chest straps 13, 14 are provided with the first and second loops 23, 24 and extend into the back portion 15, such as into the sleeves 28 arranged in the projections 29 thereof.

With reference to FIG. 8 the front part 33 of the device 10 is illustrated according to one embodiment, the front part 33 comprising the second strap portion 22 of the shoulder straps 11, 12, the second strap part 27 of the chest straps 13, 14 and the buckle 16. The second strap part 27 of the first chest strap 13 is illustrated in an unfolded position, wherein the second strap part 27 of the second chest strap 14 is illustrated in a folded position and attached to itself by means of the hook and loop fastener. A first end of the pull tab 25. The opposite second end of the second strap part 27 of the chest straps 13, 14 is attached to the buckle 16. For example, the second end of the second strap part 27 of the chest straps 13, 14 is fixed to the buckle 16. For example, the second strap part 27 of the chest straps 13, 14 is non-elastic and is e.g. formed in a non-elastic fabric, hook and loop fastener or similar. Alternatively, the second strap part 27 of the chest straps 13, 14 is formed in an elastic material, such as an elastic fabric or an elastic hook and loop fastener. The second strap portions 22 of the shoulder straps 11, 12 are attached to the second strap part 27 of the chest straps 13, 14. For example, the second strap portions 22 of the shoulder straps 11, 12 are attached at the second ends of the second strap parts 27 or close to the second end thereof and, for example, extend substantially perpendicular to the chest straps 13, 14. The second strap portions 22 of the shoulder straps 11, 12 are, for example, fixed to the chest straps 13, 14 in one end and are provided with the loop 19 in the other end. For example, the second strap portions 22 of the shoulder straps 11, 12 comprise an elastic material. For example, the second strap portions 22 comprise an elastic material in at least 50 mm. For example, the second strap portions 22 comprise an elastic material being elastically extendable at least 50% of its length in the longitudinal direction.

With reference to FIG. 9 another embodiment of the front part 33 is illustrated, wherein the second strap part 27 of the chest straps 13, 14 comprises an elastic portion 34 forming the elastic section. Then, the elastic portion 34 is arranged between the pull tab 25 and the buckle 16.

With reference to FIG. 10 the first strap part 26 of the first chest strap 13 is illustrated more in detail. The first strap part 26 of the second chest strap 14 is arranged in a corresponding manner. The first strap part 26 is attached to the back portion 15 and forms the elastic section of the chest strap 13. For example, one end of the first strap part 26 is fixed to the back portion 15, such as by means of a seam or in another suitable manner. In the illustrated embodiment the opposite second end of the first strap part 26 is provided with the second loop 24. In the illustrated embodiment, the first strap part 26 partially overlaps the back portion 15, wherein an outer portion 35 of the first strap part 26 projects from the back portion 15, such as from the peripheral seam 32, and wherein an inner portion 36 of the first strap part 26 overlaps the back portion 15, such as the projection 29. The inner portion 36 of the first strap part 26 is illustrated by means of dashed lines in FIG. 10. According to one embodiment the inner portion 36 of the first strap part 26 extends into the sleeve 28 through the aperture 31 as described above. The outer portion 35 of the first strap part 26 is arranged with a length A of at least 50 mm, such as 50-200 mm or 50-100 mm. For example, the outer portion 35 of the first strap part 26 is arranged with a length A of around 80 mm. The inner portion 36 of the first strap part 26 is arranged with a length B of at least 30 mm or at least 50 mm, such as 50-100 mm. For example, the inner portion 36 of the first strap part 26 is arranged with a length B of around 70-80 mm. For example, the entire first strap part 26 is formed in an elastic material and is arranged with a total length of at least 50 mm, at least 100 mm, or at least 150 mm. The first strap part 26 is elastically extendable in the longitudinal direction, which is illustrated by means of the arrow E in FIG. 10. For example, the first strap part 26 is elastically extendable at least 50% of its length in the longitudinal direction.

In the embodiment of FIG. 10 an optional stopping element 37 is arranged to prevent the elastic first strap part 26 from being extended beyond a predetermined length. A corresponding stopping element 37 can be arranged at any of the elastic parts of the device 10. The stopping element 37 is, e.g. formed by a non-elastic cord extending between the back portion 15 and the outer end of the first strap part 26 or correspondingly between another fixed element and an end of the elastic section. Alternatively, the stopping element 37 extends between opposite ends of the first strap part 26 or any other elastic section.

The invention claimed is:

1. A device for carrying an object, comprising first and second shoulder straps, first and second chest straps to be fitted around the lower chest of a person, and a back portion connected to a first end of the shoulder straps and a first end of the chest straps, wherein second ends of the shoulder straps are connected to the chest straps, wherein first ends of the chest straps are fixed to the back portion and second ends of the chest straps are detachably connectable to each other by means of a buckle, and wherein lengths of the chest straps are adjustable, wherein each of the chest straps comprises at least an elastic section, said elastic section being elastically extendable in a longitudinal direction of the chest straps, and wherein at least a first strap part of the chest straps comprises an elastically extendable outer portion and an elastically extendable inner portion forming the elastic section, said inner portion being attached to the back portion, and wherein the inner portion overlaps the back portion.

2. The device according to claim 1, wherein a length of the inner portion of the first strap part is at least 50 mm.

3. The device according to claim 1, wherein the total length of the elastic section is at least 100 mm.

4. The device according to claim 1, wherein the elastic section is elastically extendable at least 50% of its length in the longitudinal direction.

5. The device according to claim 1, wherein the chest straps are provided with a stopping element to prevent the elastic section from being elastically extended beyond a predetermined length.

6. The device according to claim 1, wherein the device comprises first and second loops arranged with a space between them for length adjustment of the chest straps, and wherein a part of the chest straps extends through either of said loops and is detachably connectable to itself and length adjustable.

7. The device according to claim 6, wherein the chest straps comprise a hook and loop fastener.

8. The device according to claim 1, wherein the shoulder straps comprise an elastic part forming a bounce absorber.

9. The device according to claim 1, wherein the shoulder straps comprise a first strap portion, a second strap portion and a fastening loop, wherein the first strap portion extends through the fastening loop and is detachably connectable to itself and length adjustable by means of a hook and loop fastener.

10. The device according to claim 9, wherein the first strap portion is connected to the back portion, and the second strap portion is connected to one of the chest straps.

11. The device according to claim 10, wherein the second strap portion is elastic to form the elastic part of the shoulder strap.

12. The device according to claim 1, wherein the back portion is provided with a structure for receiving the object to be carried.

13. A backpack comprising the device according to claim 1.

* * * * *